US005655759A

United States Patent [19]

Perkins et al.

[11] Patent Number: 5,655,759

[45] Date of Patent: Aug. 12, 1997

[54] APPARATUS AND METHOD OF CONTROLLING INSERTION OF SUBSTRATES INTO A STREAM OF IMAGED SUBSTRATES

[75] Inventors: William C. Perkins, Byron; Kevin R. Mathers, Churchville, both of N.Y.

[73] Assignee: Xerox Corporation, Stamford, Conn.

[21] Appl. No.: 535,804

[22] Filed: Sep. 28, 1995

[51] Int. Cl.[6] ..... B65H 39/02

[52] U.S. Cl. ..... 270/52.02; 399/76; 399/363; 399/84

[58] Field of Search ..... 355/325; 270/52.02

[56] References Cited

U.S. PATENT DOCUMENTS 4,248,525 2/1981 Sterrett .
4,536,078 8/1985 Ziehm .
4,561,772 12/1985 Smith .
4,763,161 8/1988 Forest et al. ..... 355/325 X
4,961,092 10/1990 Rabb et al. ..... 355/325 X
5,272,511 12/1993 Conrad et al. ..... 355/325

OTHER PUBLICATIONS

Xerox Disclosure Journal, Dual Function Sheet Feeder, John R. Yonovich, vol. 19, No. 4 Jul./Aug. 1994, pp. 333–336.

*Primary Examiner*—John E. Ryznic
*Attorney, Agent, or Firm*—William A. Henry, II

[57] ABSTRACT

An apparatus and method is provided for controlling the insertion of one or more special insert sheets into a steam of regular imaged sheets. A coded sheet is placed into a sheet stack in a position where an insert sheet is to be placed. Sheets are removed from the stack one by one and transported along a path past a sensor toward a finishing apparatus. When the sensor detects a coded sheet, the coded sheet is diverted from the stream and later replaced with an insert sheet.

6 Claims, 1 Drawing Sheet

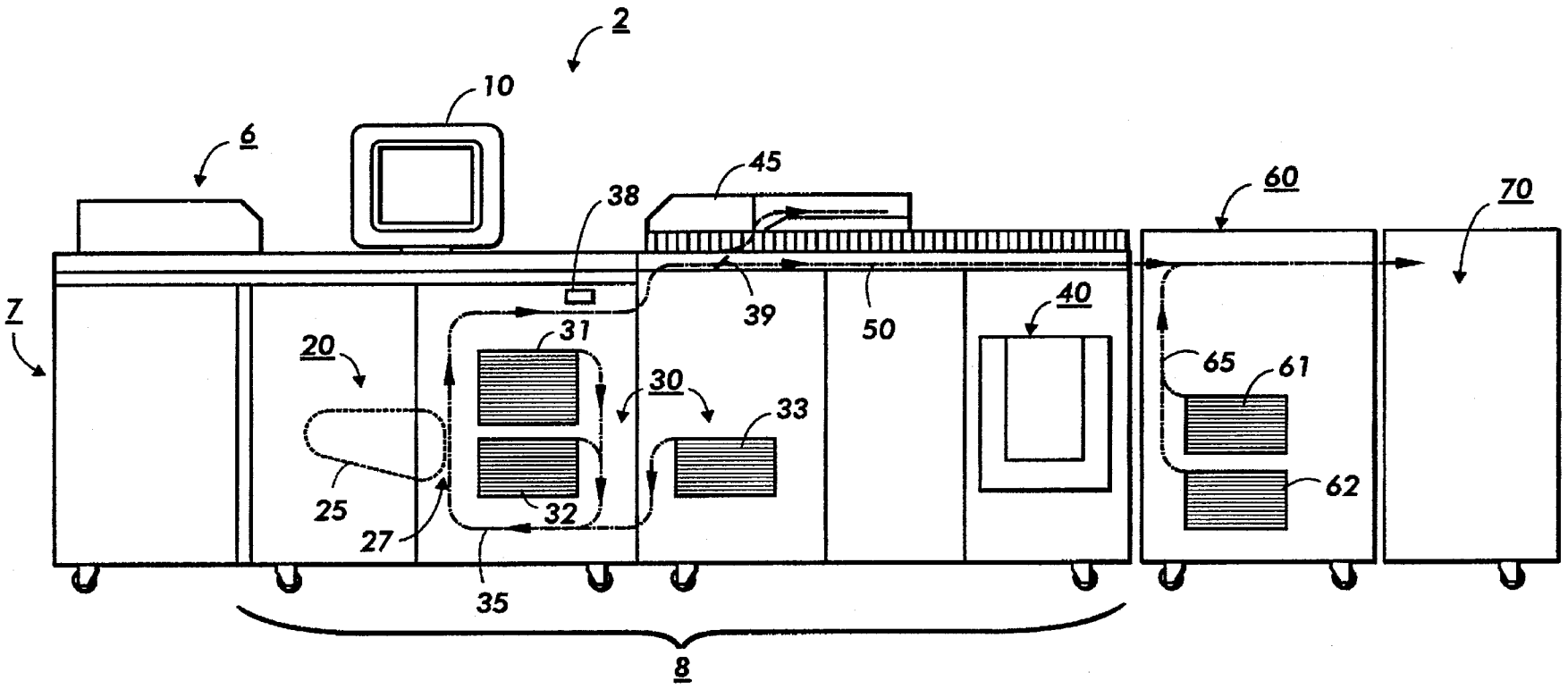
70
60
62
61
65
40
50
45
39
33
30
2
38
31
32
10
35
27
25
20
6
8
7

APPARATUS AND METHOD OF CONTROLLING INSERTION OF SUBSTRATES INTO A STREAM OF IMAGED SUBSTRATES

The present invention relates generally to a technique for producing a print job including one or more one imaged regular substrates and at least one special insert sheet, and more particularly, to an apparatus and method for interposing the at least one special insert sheet into a stream of the one or more imaged regular substrates and controlling the timing associated with the interposing process.

The primary output product of a typical printing machine is a printed substrate, such as a sheet of paper bearing printed information in a specified format. Quite often, customer requirements necessitate that this output product be configured in various specialized arrangements or print sets ranging from stacks of collated loose printed sheets to tabulated and bound booklets. Even when using state of the art document producing and finishing apparatus, it may be necessary to insert sheets into the document which are produced by means other than the document producing apparatus, or produced at a separate time from the majority of the sheets contained in the print set. For example, it is not uncommon to place specially colored sheets, chapter dividers, photographs or other special insert sheets into a print set to produce a final document. For example, it is common to use preprinted sheets which were produced by four-color offset press techniques as special insert sheets in a document containing mostly text printed on ordinary white paper. In another example, booklets produced from signatures, often use special cover sheets or center sheets containing, for example, coupons. It is generally not desirable to pass these sheets through the printer processing apparatus because the ink on the special insert sheets tends to be smudged by the paper-handling rollers, etc. of the document producing apparatus. In addition, these special insert sheets may be of a particular weight stock or may include protruding tabs which may cause jams when transported through the printer processor.

Accordingly, these special insert sheets must be inserted into the stream of sheets subsequent to processing in the printer processor section of the document producing apparatus. It is desirable to insert these sheets without disrupting the flow of the continuous stream of processed sheets. It is also desirable to insert these sheets in a manner which is transparent to the print processor on the finishing apparatus so that the operation of these apparatus need not be modified. The following disclosures relate to the area of inserting one or more insert sheets among a plurality of previously marked sheets:

U.S. Pat. No. 5,272,511
Patentees: Conrad et al.
Issued: Dec. 21, 1993

U.S. Pat. No. 4,961,092
Patentee: Rabb et al.
Issued: Oct. 2, 1990

U.S. Pat. No. 4,602,776
Patentee: York et al.
Issued: Jul. 29, 1986

U.S. Pat. No. 4,561,772
Patentee: Smith
Issued: Dec. 31, 1985

U.S. Pat. No. 4,536,078
Patentee: Ziehm
Issued: Aug. 20, 1985

U.S. Pat. No. 4,248,525
Patentee: Sterret
Issued: Feb. 3, 1981

Xerox Disclosure Journal—Vol. 19, No. 4, pp. 333–336
Patentee: John R. Yonovich
Disclosed: July/August 1994

U.S. Pat. No. 5,272,511 discloses a sheet inserter for inserting one or more special insert sheets into a continuous stream of sheets by overlaying the insert sheets with a corresponding sheet in the continuous stream of sheets. The insert sheet overlaying the corresponding sheet in the continuous stream of sheets is then conveyed with the corresponding sheet to a final destination where the sheets can be compiled into a stack.

U.S. Pat. No. 4,961,092 discloses a preprogrammed post-collation system for a copier which uses plural sorter bins and a recirculating document handler. Preprogrammable pause points in the copying operation allow for repeatedly inserting a variable number of job inserts or other special copy sheets into the bins being filled (by producing copies of these special documents or by manually inserting them into the bins), at any selected document copying point. The copying sequence must be manually restarted after the appropriate insertion operation is completed.

U.S. Pat. No. 4,602,776 discloses an insertion apparatus for use with a copier and/or a collator for providing on-line and off-line insertion of sheet material or collation, respectively. A supply tray is loaded with one or more types of insert material, each type being separated by a first type of coded sheet. A copying operation is interrupted when a second type of coded sheet, located in the stack to be copied and indicating a location where insert sheets are to be inserted, is detected. As the insert sheets are fed, a second sensor detects the first type of coded sheet (indicating the end of the group of insert sheets), which is then fed to an overflow tray. The normal copying operation is then resumed.

U.S. Pat. No. 4,536,078 discloses an automatic document handling system for recirculative document duplex copying to provide precollated simplex or duplex copies with proper image orientation on the output copy sheet for copies made on special orientation restricted copy sheets as well as non-orientation sensitive copy sheets. A switching system is provided for selecting between feeding of copy sheets from a main supply tray or a special copy sheet supply tray. A control system is provided for causing the document handling system to circulate the input copy sheets once before copying, to count the input copy sheets and to determine whether an odd or even number of input sheets are being provided to improve operating efficiency.

U.S. Pat. No. 4,561,772 to Smith discloses several approaches for inserting orientation sensitive paper into a copier with a paper path loop and two paper trays disposed adjacent the loop. With the Smith copier, orientation sensitive paper can be loaded into one of the trays for feeding into the loop in accordance with the marking requirements of a copy job. In one example, a system operator informs the controller of the copier of the presence of orientation sensitive paper by activating a switch or button. Accordingly, the copy job is processed, in part, on the basis of the switch being activated.

U.S. Pat. No. 4,248,525 discloses an apparatus for producing sets of collated copies wherein some of the sheets in a document (regular sheets) can be reproduced in a collating mode by means of a copier having a recirculating document handler (RDH), while other sheets in the document (insert sheets) cannot be produced in a collating mode by the RDH. Each sheet which cannot be imaged using the RDH is first individually copied multiple times and fed to a separate storage bin. These sheets later will be inserted into the stream of collated regular sheets as they are copied and output from the copier. A controller is preprogrammed with the page numbers of the sheets to be inserted. The regular sized sheets are then placed (in order) in the RDH, and multiple collated copies are made and fed toward a finisher (stapler). Copies of the regular sized sheets in the document are thus output from the copier in order (collated), with the insert sheets missing. Since the controller keeps track of the number of sheets being copied, the controller is able to temporarily stop the RDH at the appropriate time and cause the appropriate insert sheet to be fed from its corresponding storage bin into the stream of regular sheets output from the copier. Thus, collated complete print sets of a particular document are generated.

The Xerox Disclosure Journal article discloses a dual function sheet feeder including first and second sheet feeding paths which share common initial document path portion, diverting at a gate to provide separate functions. The first sheet feeding path allows input documents to be transported for document imaging and onward to a document restacking tray. The second sheet feeding path allows transport of input documents into a print engine input path to be merged into the regular sheet feeding path for delivery to the finisher.

All references cited in the present specification and their references are incorporated herein by reference where appropriate for appropriate teachings of additional or alternative details, features and/or technical background.

Even with the above-mentioned prior available, there is still a need for a simple means for inserting special stock into a continuous stream of substrates.

Accordingly, it is an object of the present invention to provide methods and apparatus for inserting sheets into a continuous stream of substrates without disrupting or inserting skipped pitches into the continuous stream of sheets.

It is another object of the present invention to provide a method and apparatus for inserting sheets into a continuous stream of substrates without impacting the conventional job stream and related machine control system.

To achieve the foregoing and other objects, and to overcome the shortcomings discussed above, a sheet inserter inserts special insert sheet or sheets into a continuous stream of sheets by employing an encoded trip ticket that triggers a paper path hole into which an insert sheet is placed. The insert sheet in the continuous stream of sheets is then conveyed to a final destination where the sheets can be compiled into a stack.

In a preferred embodiment, the sheet inserter is contained in a module which is removably attachable to a copier/printer and a finishing device so as to insert the special insert sheets into the stream of sheets that are output from the document producing apparatus. An encoded sheet that is placed into a copy sheet stack at the point where an insert sheet is to be placed is fed from the sheet stack and sensed by a sensor. A signal from the sensor is directed to a controller that triggers a deflector which deflects the coded sheet to a reject tray thereby creating a hole for the insertion of an insert sheet into the sheet stream. A feeder in the insert module feeds a sheet into the created hole and all of the sheets are conveyed to the finishing device in collated order.

BRIEF DESCRIPTION OF THE DRAWINGS

The invention will be described in detail with reference to the following drawings in which like reference numerals refer to like elements, and wherein:

FIG. 1 is a schematic elevational view of a copier/printer incorporating the method and apparatus for inserting sheets into a substrate stream in accordance with the present invention.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Referring to FIG. 1, there is shown an exemplary laser based printing system (or imaging device) 2 shown, for example, in U.S. Pat. No. 5,243,381 which in incorporated herein by reference for processing print jobs in accordance with the teachings of the present invention. Printing system 2, for purposes of explanation, is divided into a scanner section 6, controller section 7, and printer section 8. The control of all machine functions, including all sheet feeding, is, conventionally, by machine controller 7. The controller 7 is preferably a known programmable microprocessor system, as exemplified by extensive prior art, e.g., U.S. Pat. No. 4,475,156 and its references and is manipulated by cathode ray tube 10 which, in turn, receives command signals via a touch screen or from keyboard input. While a specific printing system is shown and described, the present invention may be used with other types of printing systems such as ink jet, ionographic, etc.

Referring to FIG. 1, printer section 8 comprises a laser type printer and, for purposes of explanation, is separated into a Raster Output Scanner (ROS) section (not shown), Print Module Section 20, Paper Supply Section 30, and High Speed Finisher 40. The ROS has a laser, the beam of which is split into two imaging beams. Each beam is modulated in accordance with the content of an image signal input by an acousto-optic modulator to provide dual imaging beams. The dual imaging beams are scanned across a moving photoreceptor 25 of Print Module 20 by the mirrored facets of a rotating polygon to expose two image lines on photoreceptor 25 with each scan and create latent electrostatic images of page image information represented by image signal input to a modulator. Photoreceptor 25 is uniformly charged by, for example, conventional corotrons at a charging station preparatory to exposure by the imaging beams. The latent electrostatic images are developed by developer and transferred at transfer station 27 to a print media or substrate delivered by Paper Supply section 30. The print media, as will appear, may comprise any of a variety of sheet sizes, types, and colors. For transfer, the print media is brought forward in timed registration with the developed image on photoreceptor 25 from either a main paper tray 31 or from auxiliary paper trays 32 or 33 through a paper path 35 represented by arrows. The developed image transferred to the print media is permanently fixed or fused by a fuser (not shown) and the resulting prints discharged to either output tray 45, to high speed finisher 40, or through bypass 50 to some other downstream finishing device, which could be a low speed finishing device, such as, a signature booklet maker (SBM) 70 of the type manufactured by Bourg AB. High speed finisher 40 includes a stitcher for stitching or stapling the prints together to form books and a thermal binder for adhesively binding the prints into books.

Referring still to FIG. 1, the SBM 70 is coupled with the printing system 2, by way of a bypass transport 50, and through interposer or sheet insert feeder module 60 for receiving printed signatures. A sheet rotary (not shown) is positioned at an input of the SBM and the SBM includes three stations, namely a stitching station, a folding station and a trimming station, in which a plurality of signatures are processed. In operation, the signatures are transported through the bypass transport 50 to the sheet rotary where the signatures are rotated, if necessary. The signatures are then introduced to the stitching station where the signatures are assembled as a stitched booklet. The stitched booklet is delivered to the folding station where it is preferably folded in half with a folding bar. At the trimming station, uneven edges of the folded signature set are trimmed with a cutting blade. Further details regarding the structure and function of the SBM 70 can be obtained by reference to U.S. Pat. No. 5,159,395 to Farrell et al.

As seen in FIG. 1, an interposing module in accordance with the present invention (also referred to below as simply "interposer") is designated by the numeral 60. Interposer 60 enables on-line insertion of substrates into a continuous stream of substrates without interruption of flow of the substrates through the use of an encoded trip ticket that triggers a paper path hole or space that allows for the insertion of a substrate into the substrate stream flow without impacting the conventional job stream and without requiring any change in stock machine software. Toward understanding the employment of the interposer in the printing system 2, imaged substrates are fed from paper trays 31, 32 or 33 through paper path 35 where images on photoreceptor 25 are transferred thereto at transfer station 27 and are conveyed past sensor 38 into bypass transport 50, through interposer 60 and then into SBM 70. Sensor detectable encoded trip tickets, which could be substrates of collated stock or a disposable copy/print created via a hard copy or electronic original with visible or invisible bar codes, are placed in the desired paper tray at the point in a substrate stack where a sheet is to be interposed into the substrate stream from interposer 70. As the coded sheet is conveyed along paper path 35 it passes sensor 38 which reads the bar code and signals controller 7 which triggers a gate 39 to deflect the coded sheet into output tray 45 thereby creating a hole or space for a sheet to be inserted.

Interposer 60 includes insert sheet trays 61 and 62 that feed inserts into paper path 65 indicated by arrows for transport to into SBM 70. Materials handled by these feeders can range, for example, from preprinted stocks, output from other xerographic devices (i.e., color), heavy papers, chrome coats or folded sheets. With this configuration of the interposer with respect to the print portion of the machine, none of these inserts would be required to go through the xerographic process. Interposer 70 is also under the control of controller 7 and the signal to the controller from sensor 38 is also used to actuate feeders connected to one of insert trays 61 or 62 to feed an insert into the space created by the ejection of the coded sheet. For a more detailed description of the use of bar codes for actuating sheet feeder trays, see related U.S. patent application Ser. No. 07/796,524, filed Nov. 22, 1991 to Robert A. Coons et al. For an example of a printing system capable of printing sheets with bar codes see U.S. Patent No. 4,757,348 to Rourke et al, the disclosure of which is incorporated herein by reference.

It should be understood that an apparatus and method has been disclosed that facilitates media insertion into a sheet stream without impacting the sheet stream flow from a printer or other source device which, heretofore, has required complex interactive communications between the source device and inserter module.

While this invention has been described in conjunction with a preferred embodiment thereof, it is evident that many alternatives, modifications and variations will be apparent to those skilled in the art. Accordingly, the preferred embodiment of the invention as set forth herein is intended to be illustrative, not limiting. Various changes may be made without departing from the spirit and scope of the invention as defined in the following claims.

What is claimed is:

1. A method of inserting insert sheets from an insert tray into a stream of sheets without disrupting a flow of the stream of sheets, comprising:

a) placing a coded sheet in a sheet stack in the position where an insert sheet is to be placed;

b) feeding all of the sheets in a continuous stream through a paper predetermined path toward a finishing apparatus;

c) providing a sensing means and sensing said coded sheet en route to the finishing apparatus;

d) providing an input sheet tray with at least one insert sheet;

e) diverting said coded sheet to a reject tray in response to said coded sheet being sensed by said sensing means thereby creating an empty space in the continuous stream of sheets; and f) inserting an insert sheet from said insert tray into said sheet stream so that the insert sheet occupies the space vacated by said coded sheet and is transported along with all other sheets toward said finishing apparatus.

2. A printing system for producing a print job, the printing system including a print engine for imaging regular substrates, fed to the print engine from a regular substrate feeding apparatus, and delivering the imaged regular substrates as an output, an interposer, a finisher and control apparatus, comprising:

a) a special sheet insertion system operatively coupled with said print engine, said special sheet insertion system including, i) special sheet insertion subsystem for holding and feeding special insert sheets, ii) a special sheet insertion path passing by said special sheet insertion subsystem, the special insert sheets being feedable to the special sheet insertion path and interposed into the delivered output of imaged regular substrates;

b) a code detector adapted to signal the presence of a code on a passing sheet;

c) an output tray;

d) a processor, communicating with the print engine and said special insert sheet insertion system, said processor, i) adapted to receive a signal from said detector indicating the presence of a coded sheet being fed from the regular substrate feeding apparatus and direct the coded sheet into said output tray; and ii) actuating said special sheet insertion subsystem to feed one of the special insert sheets into a hole created in the delivered output of imaged regular substrates.

3. A page image reproduction system wherein a continuous stream of substrates are fed to a destination with sheet inserts being interposed within the stream of substrates at a predetermined position without interrupting the flow of the substrate stream, said image reproduction system including a photoreceptor onto which latent page image information is placed, a transfer station where said latent page image information is transferred to substrates, a developing station where the latent image information on said substrates is developed and a fusing station where the developed page image information is fused to the substrates, comprising:

an output tray;

at least one substrate tray adapted to hold a stack of substrates including at least one coded substrate;

means for feeding substrates from said substrate tray to said destination;

a first feed path into which said substrates from said substrate tray are fed;

a code reader positioned before said output tray and adapted to sense substrates passing through said first feed path and provide a signal when a substrate passes that includes a code;

an interposer adapted to feed insert sheets into said first paper path;

a finisher adapted to receive substrates from said at least one substrate tray and said interposer for finishing purposes;

a rotatably mounted deflector positioned with respect to said output tray and said first paper path to deflect a substrate into said output tray when actuated; and a controller adapted to receive said signal from said code reader and actuate said deflector to direct the coded substrate into said output tray to thereby create a paper path hole in the continuous stream of substrates and thereafter actuate said interposer to feed an insert to fill said paper path hole while the continuous stream of substrates are en route to said finisher.

4. The page image reproduction system of claim 2, wherein said interposer includes a second paper path, and wherein said first paper path extends past said photoreceptor and said second paper path bypasses said photoreceptor.

5. The page image reproduction system of claim 2, wherein said code on said substrate is a bar code.

6. The page image reproduction system of claim 2, wherein said interposer is detachable and positioned between said output tray and said finisher.

* * * * *